US009011609B2

(12) United States Patent
Nakagawa et al.

(10) Patent No.: US 9,011,609 B2
(45) Date of Patent: Apr. 21, 2015

(54) IRONING METHOD AND IRONING APPARATUS

(75) Inventors: Yusuke Nakagawa, Fukuyama (JP); Masaki Tada, Fukuyama (JP); Katsumi Kojima, Fukuyama (JP); Yasuhide Oshima, Chiba (JP); Hiroki Iwasa, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 573 days.

(21) Appl. No.: 12/934,167

(22) PCT Filed: Mar. 19, 2009

(86) PCT No.: PCT/JP2009/056212
§ 371 (c)(1),
(2), (4) Date: Dec. 10, 2010

(87) PCT Pub. No.: WO2009/119781
PCT Pub. Date: Oct. 1, 2009

(65) Prior Publication Data

US 2011/0114128 A1 May 19, 2011

(30) Foreign Application Priority Data

Mar. 26, 2008 (JP) ..... 2008-079391

(51) Int. Cl.
*B21D 22/20* (2006.01)
*B21D 22/28* (2006.01)

(52) U.S. Cl.
CPC ..... *B21D 22/28* (2013.01); *B21D 22/201* (2013.01)

(58) Field of Classification Search
CPC .... B21D 22/201; B21D 22/28; B21D 22/283; B21D 22/286
USPC ..... 134/9, 15, 17, 22.18, 25.4, 41, 21, 5; 413/69
See application file for complete search history.

(56) References Cited

U.S. PATENT DOCUMENTS 3,653,249 A * 4/1972 Dunn ..... 72/349
3,893,326 A * 7/1975 Oberlander et al. ..... 72/347
(Continued)

FOREIGN PATENT DOCUMENTS

JP 55019466 A * 2/1980 ..... B21D 22/28
JP 59-51374 B2 12/1984
(Continued)

OTHER PUBLICATIONS

International Search Report dated Jun. 9, 2009, application No. PCT/JP2009/056212.

*Primary Examiner* — Michael Kornakov
*Assistant Examiner* — Katelyn Whatley
(74) *Attorney, Agent, or Firm* — RatnerPrestia

(57) ABSTRACT

An ironing apparatus includes an ironing die and an ironing punch, an injection port for injecting gas or liquid to the metal plate at a high pressure to remove substance adhered to the metal plate therefrom, a suction port for sucking the adhered substance removed from the metal plate, and a protrusion mount portion with a protrusion for preventing dispersion of the gas or the liquid. An ironing method for ironing the metal plate having the single surface or both surfaces coated with the organic resin film includes the steps of injecting the gas or the liquid from the injection port to the metal plate at the high pressure to remove the adhered substance from the metal plate, and sucking and collecting the adhered substance removed from the metal plate from the suction port. The adhered substance such as the hair may be removed by the aforementioned invention.

4 Claims, 3 Drawing Sheets

(56) References Cited

U.S. PATENT DOCUMENTS

| | | | | | |
|---|---|---|---|---|---|
| 3,924,437 | A | * | 12/1975 | Hortig | 72/349 |
| 3,930,396 | A | * | 1/1976 | Martinez | 72/347 |
| 3,945,231 | A | * | 3/1976 | Imazu et al. | 72/45 |
| 4,148,208 | A | * | 4/1979 | Maeder | 72/342.4 |
| 4,405,058 | A | * | 9/1983 | Phalin | 220/62.13 |
| 4,538,441 | A | * | 9/1985 | Nishikawa | 72/349 |
| 5,020,350 | A | * | 6/1991 | Knepp et al. | 72/45 |
| 5,356,481 | A | * | 10/1994 | Yoshimura et al. | 134/22.1 |
| 5,460,024 | A | * | 10/1995 | Meneghin et al. | 72/44 |
| 5,532,051 | A | * | 7/1996 | Nishiura et al. | 428/217 |
| 5,632,171 | A | * | 5/1997 | Kunka et al. | 72/43 |
| 5,742,993 | A | * | 4/1998 | Sun | 29/527.5 |
| 5,862,582 | A | * | 1/1999 | Sun | 29/527.7 |
| 6,044,676 | A | * | 4/2000 | Sun | 72/45 |
| 2008/0066781 | A1 | * | 3/2008 | Crocker | 134/10 |
| 2008/0229801 | A1 | * | 9/2008 | Woulds | 72/347 |
| 2014/0000333 | A1 | * | 1/2014 | Farnham | 72/339 |

FOREIGN PATENT DOCUMENTS

| | | | |
|---|---|---|---|
| JP | 5154570 | A | 6/1993 |
| JP | 9019733 | A | 1/1997 |
| JP | 2003094121 | A | 4/2003 |
| JP | 2003277885 | A | 10/2003 |
| JP | 2004-255452 | A | 9/2004 |
| JP | P2004255452 | A | 9/2004 |
| JP | 2004344940 | A | 12/2004 |
| JP | 2005296998 | A | 10/2005 |
| JP | 2007-275947 | A | 10/2007 |

* cited by examiner

IRONING METHOD AND IRONING APPARATUS

CROSS-REFERENCE TO RELATED APPLICATIONS

This application is a U.S. National Phase Application of PCT International Application No. PCT/JP2009/056212, filed Mar. 19, 2009, which claims priority to Japanese Patent Application No. 2008-079391, filed Mar. 26, 2008, the contents of these applications being incorporated by reference herein in their entirety.

FIELD OF THE INVENTION

The present invention relates to a method and an apparatus of manufacturing a DI (drawn-ironed) can formed of a metal plate coated with an organic resin film. More specifically, the present invention relates to an ironing method and an ironing apparatus for removing a hair of the organic resin film generated at an opening end of a body of the can in an ironing step.

BACKGROUND OF THE INVENTION

The DI can is formed by punching the metal plate into a circular blank, forming the blank into a cup through the drawing with one or more stages, further forming the cup into a redrawn cup through the drawing with one or more stages, and passing an ironing die with one or more stages so as to reduce a thickness of a side wall of the redrawn cup. The aforementioned series of the process will be referred to as a DI process.

Recently the metal plate coated with the resin film such as the one capable of omitting the coating step has been attempted to be applied to the DI process in view of the environmental preservation. In the case where the metal plate coated with the organic resin (or the organic resin coated metal plate) is subjected to the DI process, the resin film is likely to fall off as a hair-like peeling at the opening end of the body of the can, which is so called a hair. The hair tends to adhere to the blade for the blank punching, the punch or die for the drawing or ironing, and the portion around the area of the can manufacturing apparatus where the series of the process steps are performed, and to be accumulated thereon. The aforementioned adhesion and accumulation may cause the working defect such as the breakage of the body of the can and the mark on the can surface. The hair which is kept adhered to the body of the can deteriorates the outer appearance thereof, and triggers the working defect in such process as necking and flanging to be performed after the drawing and the ironing. The hair causes the serious problem when performing the DI processing of the organic resin coated metal plate.

Several types of the arts for coping with the problem of the hair have been disclosed.

Patent Document 1 discloses the art for avoiding generation of hair. Upon the blank punching for manufacturing a drawn can and a drawn-squeezed can made of a resin coated metal plate, stage differentials are made on edges of the blanking punch and the blanking die. The blank is punched to have the resin film on the blank edge slightly smaller than the metal plate as base, and the blank is subjected to the drawing and squeezing to form the drawn can and the drawn-squeezed can.

Patent Document 2 discloses the art for preventing generation of hair by widening the interval between the annular holding member (wrinkle suppression) and the die at the point of the effective drawing stroke length from 65 to 98% to be larger than the thickness of the work for the purpose of rendering the roll-separating force of the flange just before the end of the drawing process as the cause of the hair generation harmless, and releasing the rear end of the flange part to be drawn in.

Patent Document 3 discloses the art of drawing-ironing of the metal plate having the single surface or both surfaces coated with the organic resin, which includes the step of forming the region at the outer edge of the organic resin coated metal plate having the thickness gradually decreased toward the outermost circumferential part before performing the drawing. The aforementioned step allows the thickness of the outermost circumferential part of the organic resin coated metal plate to be smaller than the maximum thickness of the side wall of the ironed organic resin coated metal plate to prevent the resin film at the opening end of the can body from peeling off as the hair by the ironing die.

Patent Document 4 discloses the art for preventing generation of hair, which includes the steps of preliminarily coating the thermoplastic resin over the face to be made as the internal side of the can of the metal sheet, subjecting the resin coated metal plate to the drawing to form the cup, heating the peripheral circumference of the cup to subject the thermoplastic resin chip which extends to the outside from the upper end of the cup generated through the drawing to the heat shrinkage to form the exposed metal surface which contains no thermoplastic resin on the cup opening, and performing the redrawing, or redrawing-ironing process after fusing the heat shrunk resin.

Patent Document 5 discloses the art for preventing generation of hair upon manufacturing of the metal container through the cup-forming or draw-ironing forming by using the metallic sheet having at least the single surface coated with the resin film by performing laser irradiation before or after the cup-forming to remove a part of the surface-coated resin layer.

The aforementioned disclosed arts are based on the concept for preventing generation of the hair by the can manufacturing process. Meanwhile, the art for avoiding generation of the hair by controlling the metal plate property has also been disclosed.

Patent Document 6 discloses the art for avoiding generation of hair when forming the drawn-ironed can from the resin coated metal plate by adjusting the steel content and material of the steel plate as the base, further adjusting the surface strength ratio of the crystal surface to allow the use of the steel plate which is thinner than the generally employed material, reducing the substantial ironing quantity in the ironing step at which the hair is mostly generated, and suppressing the working hardening during the process to prevent increase in the deformation resistance.

Patent Document 7 discloses the art for avoiding generation of hair when subjecting the organic resin film coated steel plate to the DI forming by adjusting the steel content of the steel plate as the base and the manufacturing method for softening the strength and controlling the crystal grain size.

Patent Document 7 discloses the art for removing the adhered substance generated in the DI forming process rather than the hair. In the method for processing the drawn-ironed can for manufacturing the processed can body which employs the die with the through hole and the punch that can be inserted into the through hole having the small gap left therebetween, the work is pressed and passed through the through hole by the punch under the dry environment, and the wiping means on the punch serves to remove the substance adhered to the inner circumferential portion. The aforementioned art is based on the concept for removing the adhered substance rather than the concept for preventing generation of the adhered substance.

Patent Document 1: Japanese Unexamined Patent Application Publication No. 2003-94121

Patent Document 2: Japanese Unexamined Patent Application Publication No. 5-154570

Patent Document 3: Japanese Unexamined Patent Application Publication No. 2004-344940

Patent Document 4: Japanese Unexamined Patent Application Publication No. 9-19733

Patent Document 5: Japanese Unexamined Patent Application Publication No. 2005-296998

Patent Document 6: Japanese Unexamined Patent Application Publication No. 2003-277885

Patent Document 7: Japanese Unexamined Patent Application Publication No. 2004-255452

A flangeless cup may be obtained through the drawing while suppressing generation of the hair. However, it is impossible to suppress generation of the hair upon the ironing for reducing the thickness of the wall of the can using the ironing die with multiple stages after the drawing. In the ironing, high pressure is exerted to the drawn flangeless cup by the multi-stage ironing die to reduce the thickness of the wall of the can. As a result, the high pressure is unavoidably exerted to the cup edge, which is likely to generate the hair. The aforementioned problem occurs in spite of the use of the art as disclosed in Patent Documents 1 to 7.

Generation of the hair may need the step of removing/collecting the hair from the can manufacturing apparatus, and the step of removing the hair adhered to the drawn-ironed can after processing. This may considerably deteriorate productivity of the drawn-ironed can.

The present invention provides an ironing method and an ironing apparatus which allow removal of the adhered substance such as the hair.

SUMMARY OF THE INVENTION

Aspects of the present invention provide the following features.

[1] An ironing method for ironing a metal plate having a single surface or both surfaces coated with an organic resin film includes the steps of injecting a gas or a liquid to the metal plate at a high pressure to remove an adhered substance from the metal plate, and sucking and collecting the adhered substance removed from the metal plate.

[2] In the ironing method according to [1], a high pressure injection to the metal plate is performed before and/or after ironing to the metal plate.

[3] In the ironing method according to [1] or [2], the adhered substance is sucked and collected together with the gas or the liquid used for the high pressure injection to the metal plate.

[4] An ironing apparatus for ironing a metal plate having a single surface or both surfaces coated with an organic resin film includes an ironing die and an ironing punch for performing a drawing-ironing process to a circularly punched blank from the metal plate to form a cup, an injection port through which a gas or a liquid is injected to the metal plate at a high pressure to remove an adhered substance adhered to the metal plate therefrom, a suction port for sucking and collecting the adhered substance removed from the metal plate, and a protrusion mount portion provided with a protrusion for preventing dispersion of the gas or the liquid.

[5] In the ironing apparatus according to [4], a plurality of the ironing dies, the injection ports, and the suction ports are provided.

[6] In the ironing apparatus according to [4] or [5], the protrusion includes a metal plate contact portion to be in contact with the metal plate, and the metal plate contact portion is formed of a soft elastically deformable material.

DETAILED DESCRIPTION OF THE INVENTION

As a result of vigorous investigation of the inventors to solve the aforementioned problem, the following knowledge is obtained.

It is confirmed that the organic resin film on the organic resin coated metal plate interposed between the punch and the ironing die is slidably moved at the cup edge in the course of such process as drawing, redrawing and ironing to break the organic resin film into the film hair.

The inventors have obtained the knowledge that application of the high pressure gas or liquid to the edge portion of the metal plate to which the hair is adhered allows the adhered substance such as the hair to be removed from the metal plate, and the generated hair is removed and collected together with the gas or the liquid.

Aspects of the present invention have been made based on the aforementioned knowledge.

The metal plate employed for the present invention may be formed of the arbitrary material such as the steel plate and the aluminum plate without being limited to the specific type. The thickness of the metal plate is not limited to the specific size. The metal plate with the treated surface may also be employed.

Any type of the organic resin film may be used for coating the single surface or both surfaces of the metal plate, and the thickness of the film is not limited to the specific size. The aforementioned type and the thickness may be arbitrarily selected depending on the usage of the formed product.

Embodiments of the present invention are characterized in that upon ironing of the metal plate having the single surface or both surfaces coated with the organic resin film, the high pressure gas or liquid is injected to the metal plate for removing and collecting the adhered substance from the metal plate. Preferably, the adhered substance is sucked and collected together with the gas or the liquid injected to the metal plate.

Figure 1:
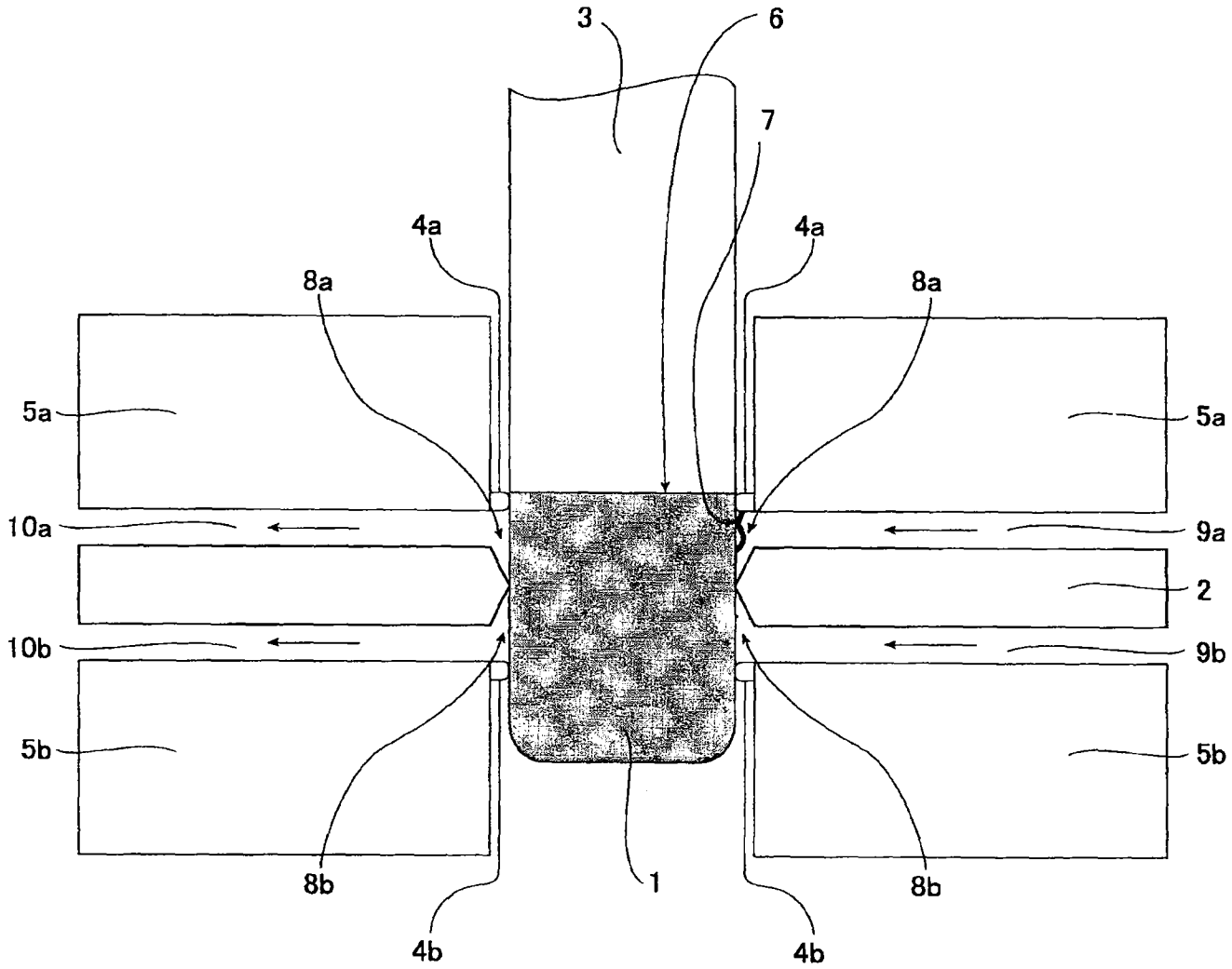
FIG. 1 is a sectional view of an ironing apparatus according to an example of the present invention.
Figure 2:
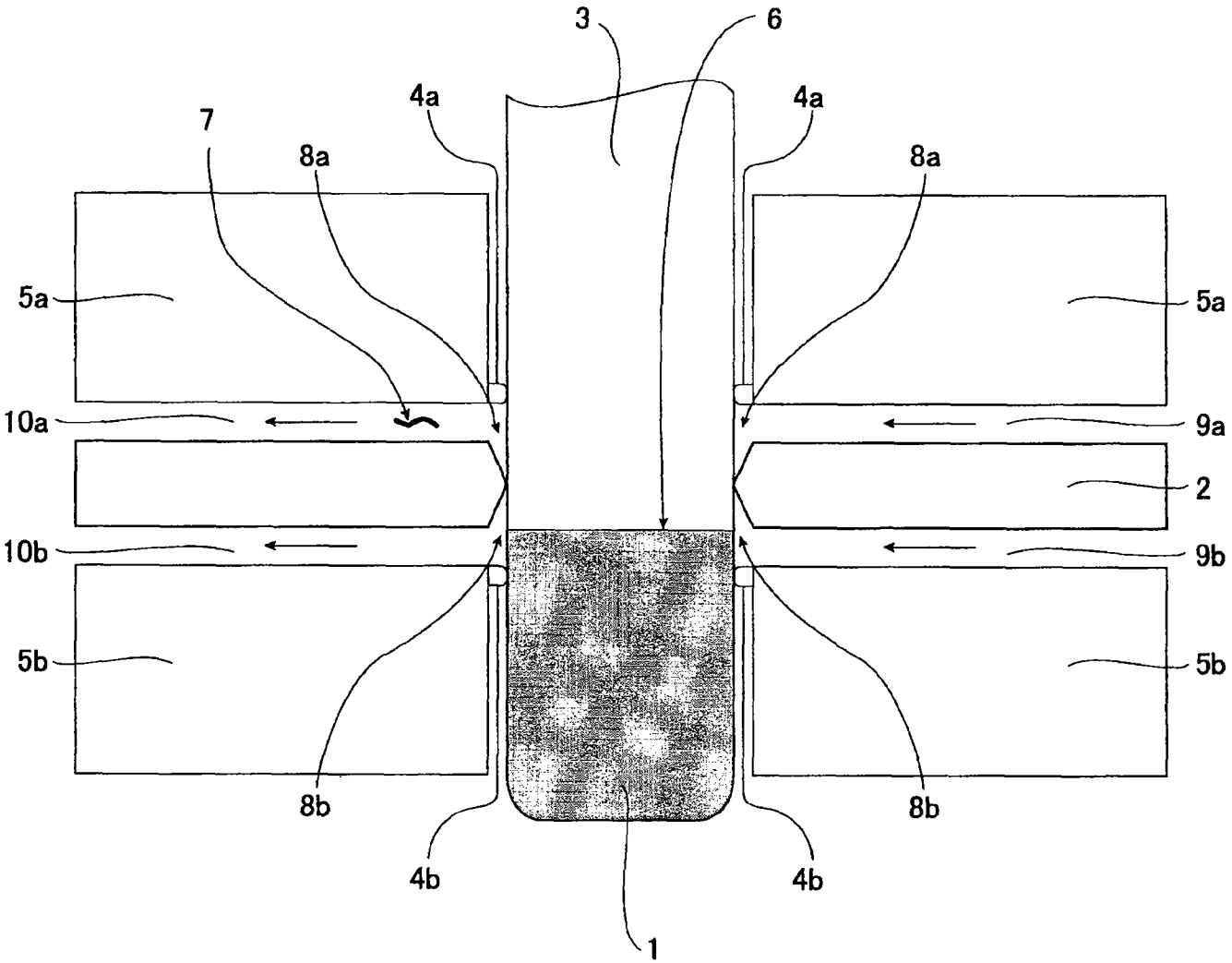
FIG. 2 is a sectional view of an ironing apparatus according to an example of the present invention.

FIGS. 1 and 2 are sectional views each representing an example of the ironing apparatus according to the present invention.

FIGS. 1 and 2 show the apparatus for ironing a metal plate 1 having the single surface or both surfaces coated with the organic resin film (hereinafter referred to as the metal plate). Referring to FIGS. 1 and 2, the apparatus is provided with an ironing die 2 and an ironing punch 3 for forming the blank circularly punched from the metal plate 1 into a cup through the drawing-ironing process, and a protrusion mount portion 5 provided with a protrusion 4 including a metal contact portion (not shown) formed of the soft elastically deformable material that can be in contact with the metal plate for preventing dispersion of the gas and/or liquid. The apparatus is further provided with an injection port 9 for removing the adhered substance (hair) 7 generated around a cup edge portion 6 of the metal plate 1, and a suction port 10 for sucking the adhered substance (hair) 7 removed from the metal plate 1. The apparatus is provided with a plurality of the protrusion mount portions 5, that is, 5*a* and 5*b*, the injection ports 9, that is, 9*a* and 9*b*, and the suction ports 10, that is, 10*a* and 10*b* provided at the regions before and after processing performed by the ironing die 2, respectively for the purpose of enhancing the hair collection efficiency. The high pressure gas or liquid may be injected to the metal plate 1 into sealed spaces 8*a* and 8*b* each defined by the ironing die 2, the protrusion mount portion 5, and the metal plate 1 or the ironing punch 3.

Referring to FIG. 1, the side wall portion of the drawn cup is clamped by the ironing punch 3 to be ironed such that the thickness of the drawn cup is reduced to be smaller. The aforementioned ironing reduces the thickness of the metal plate 1, and causes the ironing die 2 to apply high pressure to the cup edge portion 6 to break the organic resin film layer, thus generating the hair 7. As shown in FIG. 1, while the cup edge portion 6 is passing through the protrusion 4*a*, and the sealed region 8*a* defined by the ironing die 2 and the protrusion 4*a*, the high pressure gas or liquid is injected from the injection port 9*a* to the cup edge portion 6 where the hair 7 is generated.

FIG. 2 is a sectional view of the apparatus according to the present invention in the state after the cup edge portion 6 has passed through the ironing die 2 in the ironing continuously performed as shown in FIG. 1. In the region before ironing as shown in FIG. 1, the high pressure gas or liquid is injected from the injection port 9*a* to the cup edge portion 6 where the hair 7 is generated, and the hair 7 is removed. The hair 7 is then sucked by the suction port 10*a* together with the gas or the liquid so as to be removed and collected simultaneously with the ironing.

Figure 3:
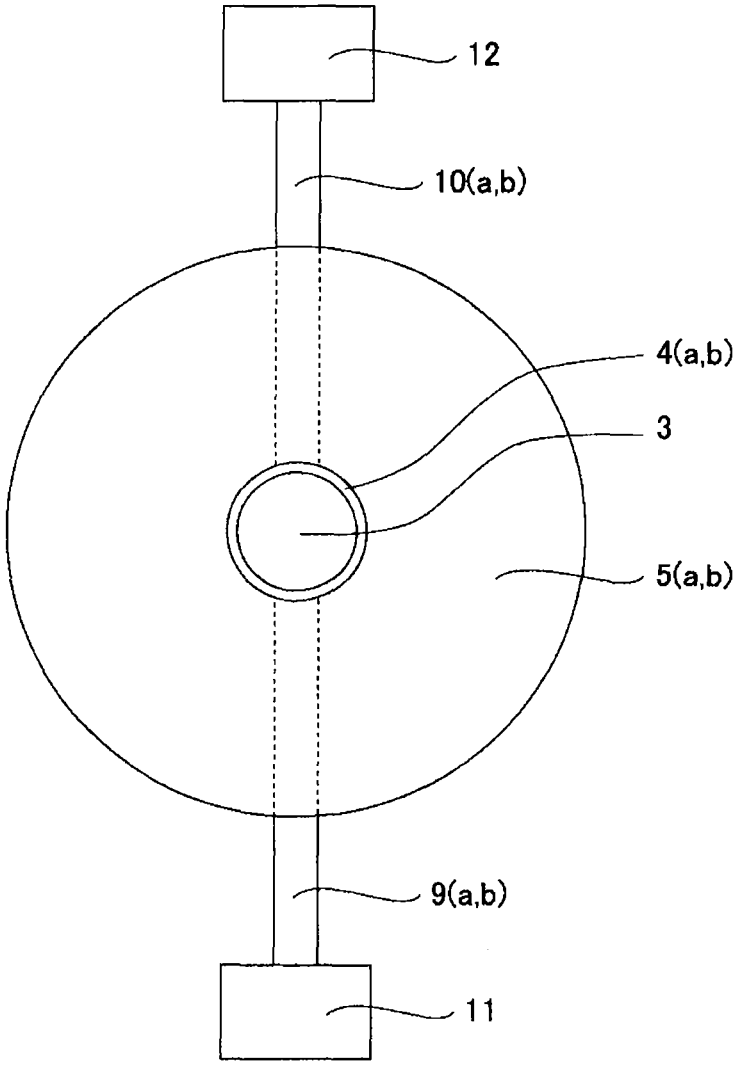
FIG. 3 is a top view of an ironing apparatus according to an example of the present invention.

FIG. 3 is a top view of the ironing apparatus shown in FIG. 1. As shown in FIG. 3, at least one of the injection ports 9*a* and 9*b*, and at least one of the suction ports 10*a* and 10*b* are formed on the peripheral circumference of the can to be processed. The gas or the liquid injected from an injection unit 11 is sprayed to the surface of the can body through the injection ports 9*a* and 9*b* to remove the foreign substance such as the film hair from the can body. Then the gas or the liquid is sucked by a suction unit 12 into the suction ports 10*a* and 10*b* together with the film hair so as to be collected. The injection ports 9*a*, 9*b* and the suction ports 10*a*, 10*b* are provided in the arrangement from outside the ironing apparatus toward the center of the ironing hole. Preferably, the suction operation is performed at the degree of vacuum of 0.1 MPa or less to ensure that no adhered substance removed by the injected gas or liquid resides in the ironing apparatus.

In aspects of the present invention, it is desirable to employ the material which does not chemically react with the metal plate, the organic resin film coated on the metal plate, and the processing device such as the ironing die as the gas or the liquid to be injected to the metal plate at the high pressure for removing the adhered substance such as the hair adhered to the metal plate. For example, air or purified water to which the rustproof agent is added may be employed as the gas or the liquid, respectively. It is preferable to use such material as wax, lanolin, fatty acid, triethanolamine, and inorganic alkali as the rustproof agent to be added to the purified water. Preferably the injection pressure is in the range from 0.4 to 20 MPa. The injection may be performed at the pressure so as not to damage the organic resin film coated on the metal plate. The protrusion mount portion 5 includes the protrusion 4 for preventing dispersion of the gas and/or liquid. The leading end of the protrusion 4 is provided with the metal contact portion which can be in contact with the metal plate to allow the contact therewith so as not to damage the organic resin film coated thereon. It is preferable to use the soft elastically deformable material as the metal plate contact portion. For example, the resin and rubber may be employed as the soft elastically deformable material.

EXAMPLE

A laminated steel plate formed by using a thermally fused PET film with the thickness of 15 μm on both surfaces of the steel plate with the thickness of 0.22 mm as the base was ironed by the ironing apparatus shown in FIG. 1.

Specifically, the cup formed by drawing the laminated steel plate was used to be subjected to the drawing at the first stage with the drawing ratio of 1.6. The cup obtained at the first stage was further drawn at the second stage with the drawing ratio of 1.5. The ironing at the third stage was performed such that the thickness of the wall portion at the side of the processed can became 0.150 mm. The film was collected after the ironing at the third stage. Each diameter of the injection ports 9*a*, 9*b* and the suction ports 10*a*, 10*b* was set to 3 mm, and each interval between the injection/suction ports 9*a*, 9*b*, and 10*a*, 10*b* and the can body in the sealed spaces 8*a* and 8*b* was set to approximately 1 mm.

Table 1 represents states resulting from generation of the film hair through the processes. Table 1 represents evaluations with respect to collection of the film hair at three levels. The code "x" denotes that the film hair cannot be collected, the code "Δ" denotes that the film hair is partially collected, and the code "○" denotes that all the film hair is collected.

TABLE 1

| | Processing type | Injected material | Injection pressure (MPa) | Effect for film hair collection |
|---|---|---|---|---|
| Comparative Example 1 | Dry | None | Zero | X |
| Comparative Example 2 | Dry | $N_2$ | 0.3 | Δ |
| Comparative Example 3 | Wet | Coolant + Purified water | 0.3 | Δ |
| Example 1 | Dry | $N_2$ | 0.4 | ○ |
| Example 2 | Dry | $N_2$ | 1.0 | ○ |
| Example 3 | Dry | $N_2$ | 10.0 | ○ |
| Example 4 | Dry | $N_2$ | 20.0 | ○ |
| Example 5 | Wet | Coolant + Purified water | 0.4 | ○ |
| Example 6 | Wet | Coolant + Purified water | 1.0 | ○ |
| Example 7 | Wet | Coolant + Purified water | 10.0 | ○ |
| Example 8 | Wet | Coolant + Purified water | 20.0 | ○ |

Table 1 confirms that each use of the liquid (coolant+purified water) and the gas ($N_2$) to be injected is effective for collecting the film hair, and the condition at the injection pressure of 0.4 MPa or higher is effective for completely collecting the hair.

The processing method according to the present invention allows the film hair collection which has been difficult for the generally employed method to realize, thus reducing the defective upon manufacturing of the can while establishing the excellent productivity.

++ Aspects of the present invention provide the processing method which allows the substance (hair) generated upon the ironing and adhered to the metal plate to be removed and collected simultaneously with the processing step. This makes it possible to avoid the conventional problem that the hair generated during the ironing resides to be kept adhered to the ironing apparatus to damage the surface of the metal plate upon the subsequent ironing, which triggers the defective in the processing. The present invention, thus, is capable of providing the excellent productivity.

Aspects of the present invention are capable of omitting the steps of removing the hair adhered to the ironed metal plate, and removing and collecting the hair which resides in the ironing apparatus.

As the gas or the liquid may be used for removing the adhered substance, the present invention is applicable to the processing method of both dry type and wet type. This makes it possible to collect the adhered substance such as the hair without being restricted to the processing conditions.

The invention claimed is:

1. An ironing method comprising:

ironing a metal plate having a single surface or both surfaces coated with an organic resin film into a cup;

injecting a gas or a liquid to the metal plate at a high pressure to remove an adhered substance from the metal plate during the ironing step, the gas or liquid being injected toward the metal plate radially through an injection port formed in an ironing apparatus extending towards a peripheral circumference of the cup;

sucking and collecting the adhered substance removed from the metal plate during the ironing step, the adhered substance being sucked away from the metal plate radially through a suction port, wherein sucking is performed at the degree of vacuum of 0.1 MPa or less and greater than 0 MPa; and reducing dispersion of the gas or liquid by a protrusion extending toward the metal plate;

wherein in the injecting step the gas or the liquid is injected into the metal plate at a pressure of 0.4 MPa or higher.

2. The ironing method according to claim 1, wherein the adhered substance is sucked and collected together with the gas or the liquid used for the high pressure injection to the metal plate.

3. The ironing method according to claim 1, wherein in the injecting step the gas or the liquid is injected into the metal plate at a pressure between 0.4 and 20 MPa.

4. An ironing method comprising:

ironing a metal plate having a single surface or both surfaces coated with an organic resin film;

injecting a gas or a liquid to the metal plate at a high pressure to remove an adhered substance from the metal plate during the ironing step, the gas or liquid being injected toward the metal plate radially through an injection port;

sucking and collecting the adhered substance removed from the metal plate during the ironing step, the adhered substance being sucked away from the metal plate radially through a suction port, wherein sucking is performed at the degree of vacuum of 0.1 MPa or less and greater than 0 MPa; and reducing dispersion of the gas or liquid by a protrusion extending toward the metal plate;

wherein in the injecting step the gas or the liquid is injected into the metal plate at a pressure of 0.4 MPa or higher; and wherein the injection port and suction port are oriented along a common plane and the injecting step and the sucking and collecting step further comprise injecting and sucking radially along the common plane.

* * * * *